US006319361B1

(12) United States Patent
Smith et al.

(10) Patent No.: US 6,319,361 B1
(45) Date of Patent: Nov. 20, 2001

(54) PAPER PRODUCTS HAVING WET STRENGTH FROM ALDEHYDE-FUNCTIONALIZED CELLULOSIC FIBERS AND POLYMERS

(75) Inventors: David Jay Smith, Montgomery; Michael Martyn Headlam, Cincinnati, both of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/569,814

(22) Filed: May 12, 2000

Related U.S. Application Data

(63) Continuation of application No. 08/962,891, filed on Nov. 14, 1997, now abandoned, which is a continuation of application No. 08/623,309, filed on Mar. 28, 1996, now abandoned.

(51) Int. Cl.[7] ..... D21H 11/20; D21H 17/20; D21H 21/20

(52) U.S. Cl. ..... 162/146; 162/9; 162/157.6; 162/158; 162/164.1; 162/168.1; 162/175; 162/178

(58) Field of Search ..... 162/9, 157.6, 158, 162/65, 168.1, 178, 164.1, 175, 146

(56) References Cited

U.S. PATENT DOCUMENTS

| | | | |
|---|---|---|---|
| 2,685,508 | 8/1954 | Spear | 92/21 |
| 2,803,558 | 8/1957 | Fronmuller . | |
| 2,988,455 | 6/1961 | Rosenberg et al. | 106/169 |
| 3,062,652 | 11/1962 | Jeffreys et al. . | |
| 3,084,057 | 4/1963 | Jordan | 106/205 |
| 3,086,969 | 4/1963 | Slager . | |
| 3,096,228 | 7/1963 | Day et al. . | |
| 3,138,473 | 6/1964 | Floyd et al. | 106/205 |
| 3,171,773 | 3/1965 | Estes et al. . | |
| 3,205,125 | 9/1965 | Ople et al. | 162/178 |
| 3,225,028 | 12/1965 | Nordgren | 260/209 |
| 3,236,832 | 2/1966 | Ople et al. | 260/209 |
| 3,239,500 | 3/1966 | Keen et al. | 260/209 |
| 3,297,604 | 1/1967 | Germino | 260/17.4 |
| 3,317,370 | 5/1967 | Kekish . | |
| 3,370,590 | 2/1968 | Hokanson et al. . | |
| 3,410,828 | 11/1968 | Kekish | 525/326.9 |
| 3,519,618 | 7/1970 | Parmerter . | |
| 3,553,193 | 1/1971 | Le Roy et al. . | |
| 3,556,932 | 1/1971 | Coscia et al. . | |
| 3,632,802 | 1/1972 | BeMiller et al. . | |
| 3,683,917 | 8/1972 | Comerford | 128/287 |
| 3,691,153 | 9/1972 | Vemuri | 260/209 |
| 3,740,391 | 6/1973 | Williams et al. . | |
| 3,784,488 | 1/1974 | Steinhauer et al. . | |
| 3,853,816 | 12/1974 | Williams et al. . | |
| 3,873,614 | 3/1975 | Lamberti et al. | 260/535 P |
| 3,880,832 | 4/1975 | Tessler . | |
| 4,022,965 | 5/1977 | Goheen et al. | 536/56 |
| 4,097,427 | 6/1978 | Aitken et al. . | |
| 4,117,187 | 9/1978 | Adams et al. . | |
| 4,129,722 | 12/1978 | Iovine et al. | 536/43 |
| 4,242,408 | 12/1980 | Evani et al. . | |
| 4,269,975 | 5/1981 | Rutenberg et al. | 536/114 |
| 4,557,801 | 12/1985 | Avis | 162/157 |
| 4,603,176 | 7/1986 | Bjorkquist et al. . | |
| 4,605,702 | 8/1986 | Guerro et al. | 525/154 |
| 4,675,394 | 6/1987 | Solarek et al. | 536/43 |
| 4,683,298 | 7/1987 | Yalpani | 536/45 |
| 4,703,116 | 10/1987 | Solarek et al. . | |
| 4,731,162 | 3/1988 | Solarek et al. . | |
| 4,741,804 | 5/1988 | Solarek et al. . | |
| 4,749,800 | 6/1988 | Jobe et al. . | |
| 4,804,769 | 2/1989 | Solarek et al. . | |
| 4,866,151 | 9/1989 | Tsai et al. . | |
| 4,954,538 | 9/1990 | Dauplaise et al. . | |
| 4,959,466 | 9/1990 | White | 536/119 |
| 4,981,557 | 1/1991 | Bjorkquist | 162/168.2 |
| 4,983,748 | 1/1991 | Tsai et al. . | |
| 5,008,344 | 4/1991 | Bjorkquist . | |
| 5,085,736 | 2/1992 | Bjorkquist . | |
| 5,138,002 | 8/1992 | Bjorkquist . | |
| 5,217,576 | 6/1993 | Van Phan . | |
| 5,262,007 | 11/1993 | Phan et al. . | |

(List continued on next page.)

FOREIGN PATENT DOCUMENTS

| | | |
|---|---|---|
| 428 420 | 6/1967 | (CH) . |
| 1 077 221 A1 | 2/2001 | (EP) . |
| 1 077 285 A1 | 2/2001 | (EP) . |

(List continued on next page.)

OTHER PUBLICATIONS

Casey, Pulp and Paper, 3rd ed., vol. III, (1981),John Wiley and Sons, pp. 1505, 1506.*

Swanson, "Conversion of Mannogalactan Micilages in Aqueous Borax Solutions for Use as Tub–sizing and Coating Adhesives", *TAPPI*, vol. 33, No. 2, pp. 77–81, (1950).

(List continued on next page.)

*Primary Examiner*—Peter Chin

(74) *Attorney, Agent, or Firm*—Julia A. Glazer; Edward J. Milbrada; David M. Weirich

(57) ABSTRACT

Paper products having high initial wet strengths are disclosed. The paper products comprise cellulosic fibers having free aldehyde groups, which fibers are combined with a water-soluble polymer having functional groups that are reacted with the aldehyde groups to form bonds joining the fibers.

In a preferred embodiment, the cellulosic fibers contain a polysaccharide in which the hydroxyl groups of at least a portion of the repeating units of the polysaccharide are cis-hydroxyl groups, preferred repeating units being mannose and/or galactose. Similarly, the water-soluble polymer is preferably a polysaccharide in which the hydroxyl groups of at least a portion of the repeating units of the polysaccharide are cis-hydroxyl groups. Preferred polysaccharides are derived from one or more sugars selected from mannose, galactose, allose, altrose, gulose, talose and lyxose.

20 Claims, No Drawings

U.S. PATENT DOCUMENTS

| | | | |
|---|---|---|---|
| 5,320,711 | 6/1994 | Dauplaise et al. . | |
| 5,334,756 | 8/1994 | Likibi et al. . | |
| 5,338,406 | 8/1994 | Smith | 162/168.2 |
| 5,338,407 | 8/1994 | Dasgupta | 162/168.2 |
| 5,362,868 | 11/1994 | Eul et al. . | |
| 5,397,435 | 3/1995 | Ostendorf et al. | 162/112 |
| 5,405,501 | 4/1995 | Phan et al. | 162/127 |
| 5,504,246 | 4/1996 | Likibi et al. . | |
| 5,638,284 | 6/1997 | Helmer et al. . | |
| 5,656,746 | 8/1997 | Smith et al. . | |
| 5,690,790 | 11/1997 | Headlam et al. | 162/175 |
| 5,698,688 | 12/1997 | Smith et al. . | |
| 5,723,022 | 3/1998 | Dauplaise et al. . | |
| 5,739,352 | 4/1998 | Barner et al. . | |
| 5,760,212 | 6/1998 | Smith | 536/123 |
| 5,958,187 | 9/1999 | Bhat et al. . | |
| 6,059,928 | 5/2000 | Van Luu et al. . | |
| 6,228,126 | 5/2001 | Cimecioglu et al. . | |

FOREIGN PATENT DOCUMENTS

| | | | |
|---|---|---|---|
| 1 077 286 A1 | 2/2001 | (EP) . | |
| 0 175 113 A2 | 3/1986 | (EP) | C08B/31/12 |
| 912279 | 12/1962 | (GB) . | |
| 928591 | 6/1963 | (GB) . | |
| 939389 | 10/1963 | (GB) . | |
| 998521 | 7/1965 | (GB) . | |
| 1056711 | 1/1967 | (GB) . | |
| 1554002 | 10/1979 | (GB) | A41B/13/02 |
| 00211687A A | 8/2000 | (JP) . | |
| 63035603 | 2/1988 | (JP) | C08B/11/04 |
| WO 95/07303 A1 | 3/1995 | (WO) . | |
| WO 96/38484 A1 | 12/1996 | (WO) . | |
| WO 98/54237 A1 | 12/1998 | (WO) . | |
| WO 99/23117 A1 | 5/1999 | (WO) . | |
| WO 99/23240 A1 | 5/1999 | (WO) . | |
| WO 99/57158 A1 | 11/1999 | (WO) . | |
| WO 00/50388 A1 | 8/2000 | (WO) . | |
| WO 00/50462 A1 | 8/2000 | (WO) . | |
| WO 00/50463 A1 | 8/2000 | (WO) . | |
| WO 01/00681 A1 | 1/2001 | (WO) . | |
| WO 95/25847 | 9/1995 | (WO) | D21H/17/24 |
| WO 95/26441 | 10/1995 | (WO) | D21H/27/38 |

OTHER PUBLICATIONS

Haug, "Purification and Characterization of Purified Fraction", *TAPPI*, vol. 36, No. 1, pp. 47–51 (1953).

Haug, "Guar Mannogalactin Studies. II. Effect of Certain Variables, Including Borax, on the Rate of Oxidation of the Purified Mucilage", *TAPPI*, vol. 36, No., pp. 53–58 (1953).

Opie, "Dialdehyde Galactomannan Gums as Wet End Wet and Dry Strength Additives", *TAPPI*, vol. 47, No. 8, pp. 504–507 (1964).

Yiannos, "Gums—Vegetable", 8–7, *Handbook of Pulp and Paper Technology*, ($2^{nd}$ Ed., Britt, Van Nostrand Reinhold Co.), pp. 650–654, (1964).

Browning, "Wood Chemistry", 1–1, *Handbook of Pulp and Paper Technology*($2^{nd}$ Ed., Birtt, Van Nostrand Reinhold Co.), pp. 3–12, (1964).

Hui et al., "Some Properties of Glactomannans", *TAPPI*, vol. 47, No. 1, pp. 39–42, (1964).

Neogi, A.N. et al., "Wet Strength Improvement via Fiber Surface Modification", Tappi, vol. 63, No. 8, pp. 86–88, (Aug. 1980).

Young, R.A., "Bonding of Oxidized Cellulose Fibers And Interaction with Wet Strength Agents", vol. 10, No. 2, pp. 112–119 (Summer 1978).

Angibeaud, P. et al., "Cellulose and Starch Reactivity with Ozone", Cellulose and Its Derivatives, Chapter 13, pp. 161–171 (1985).

* cited by examiner

PAPER PRODUCTS HAVING WET STRENGTH FROM ALDEHYDE-FUNCTIONALIZED CELLULOSIC FIBERS AND POLYMERS

This application is a continuation of Ser. No. 08/962,891 filed Nov. 14, 1997, abandoned, which is a continuation of Ser. No. 08/623,309 filed Mar. 28, 1996, now abandoned.

FIELD OF THE INVENTION

The present invention relates to paper products having a relatively high initial wet strength. More particularly, the invention relates to paper products comprising aldehyde-functionalized cellulosic fibers and polyhydroxy polymers that are reactive with the cellulosic fibers.

BACKGROUND OF THE INVENTION

Paper webs or sheets, sometimes called tissue or paper tissue webs or sheets, find extensive use in modern society. These include such staple items as paper towels, facial tissues and sanitary (or toilet) tissues. These paper products can have various desirable properties, including wet and dry tensile strength.

Wet strength is a desirable attribute of many disposable paper products that come into contact with water in use, such as napkins, paper towels, household tissues, disposable hospital wear, etc. In particular, it is often desirable that such paper products have sufficient wet strength to enable their use in the moistened or wet condition. For example, moistened tissue or towel may be used for body or other cleaning. Unfortunately, an untreated cellulose fiber assemblage will typically lose 95% to 97% of its strength when saturated with water such that it cannot usually be used in the moistened or wet condition. Therefore, several approaches have been taken to impart wet strength to paper products.

Paper products develop dry strength in part due to interfiber hydrogen bonding. When the paper product is wetted, water disrupts the hydrogen bonds and, as a consequence, lowers the strength of the paper product. Historically, wet strength of paper products has been increased primarily by two approaches. One approach is to prevent water from reaching and disrupting the interfiber hydrogen bonds, for example, by coating the paper product. Another approach is to incorporate additives in the paper product which contribute toward the formation of interfiber bonds which are not broken or, for temporary wet strength, which resist being broken, by water. The second approach is commonly the technique of choice, especially for tissue products. In this latter approach, a water soluble wet strength resin may be added to the pulp, generally before the paper product is formed (wet-end addition). The resin generally contains cationic functionalities so that it can be easily retained by the cellulose fibers, which are naturally anionic.

A number of resins have been used or disclosed as being particularly useful for providing wet strength to paper products. Certain of these wet strength additives have resulted in paper products with permanent wet strength, i.e., paper which when placed in an aqueous medium retains a substantial portion of its initial wet strength over time. Exemplary resins of this type include urea-formaldehyde resins, melamine-formaldehyde resins and polyamide-epichlorohydrin resins. Such resins have limited wet strength decay.

Permanent wet strength in paper products is often an unnecessary and undesirable property. Paper products such as toilet tissues, etc., are generally disposed of after brief periods of use into septic systems and the like. Clogging of these systems can result if the paper product permanently retains its hydrolysis-resistant strength properties. Therefore, manufacturers have more recently added temporary wet strength additives to paper products for which wet strength is sufficient for the intended use, but which then decays upon soaking in water. Decay of the wet strength facilitates flow of the paper product through septic systems. Numerous approaches for providing paper products claimed as having good initial wet strength which decays significantly over time have been suggested.

For example, U.S. Pat. No. 3,556,932, Coscia et al., issued Jan. 19, 1971; U.S. Pat. No. 3,740,391, Williams et al., issued Jun. 19, 1973; U.S. Pat No. 4,605,702, Guerro et al., issued Aug. 12, 1986; and U.S. Pat. No. 3,096,228, Day et al., issued Jul. 2, 1983, describe additives that are suggested for imparting temporary wet strength the paper. In addition, modified starch temporary wet strength agents are marketed by the National Starch and Chemical Corporation (Bloomfield, N.J.). This type of wet strength agent can be made by reacting dimethoxyethyl-N-methylchloracetamide with cationic starch polymers. Modified starch wet strength agents are also described in U.S. Pat. No. 4,675,394, Solarek, et al., issued Jun. 23, 1987. Additional wet strength resins are disclosed in U.S. Pat. No. 3,410,828, Kekish, issued Nov. 12, 1968 and its parent, U.S. Pat. No. 3,317,370, Kekish, issued May 2, 1967.

Still other additives have been used in the papermaking process to impart a level of dry and/or wet strength to the paper product. One type of strength additive are the galactomannan gums such as guar gum and locust bean gum. These gums and their use in paper are described in more detail in *Handbook of Pulp and Paper Technology,* 2nd Ed., Britt, pp. 650–654 (Van Nostrand Reinhold Co. 1964), incorporated herein by reference. The galactomannan gums generally impart dry strength to paper products. Unfortuately, in addition to having dry strength, the paper products incorporating such gums tend to be harsh to the hand. Therefore, the galactomannan gums have found utility in printing and writing paper but generally have not been useful in paper products where softness is a desirable characteristic, such as toilet tissue and facial tissue.

It is also well known to those knowledgeable in pulp bleaching, that oxidative bleaching of cellulose fibers outside the optimum pH (10 or greater) and temperature conditions can result in formation of carbonyl groups in the fibers, in the form of ketones and/or aldehydes. For example hypochlorite bleaching in the neutral pH range, will produce such a result (Cellulose Chemistry and Its Applications, T. P. Nevell & S. H. Zeronian, Eds, pp. 258–260, Ellis Harwood Ltd. Pub., West Sussex, England, 1985). Chlorine bleaching without free radical scavengers, e.g. chlorine dioxide, will also produce fibers with an elevated carbonyl content (The Bleaching of Pulp 3rd Ed., R. P. Singh Ed., pp. 40–42 & 64–65, TAPPI Press, Atlanta, Ga., 1979) as will ozone bleaching to the point of fiber degradation (M. P. Godsay & E. M. Pierce, AIChe Symposium Series, No. 246, Vol. 81, pp. 9–19). However, ketone groups do not provide significant wet strength properties to the paper product. Rather, the dry and the minimal wet strength of the untreated products are determined primarily by the existence of interfiber hydrogen bonds. Intermediate oxidations that may result in the formation of aldehydes have heretofore not been desired, since the presence of aldehyde groups tends to cause yellowing of the cellulosic fibers over time.

It is also known that certain chemicals can by intent produce cellulose fibers with an elevated aldehyde content.

Examples of these are sodium periodate, periodic acid and sodium or potassium dichromate at mildly acidic pH (Cellulose Chemistry and Its Applications, T. P. Nevell & S. H. Zeronian, Eds., pp. 249–253 & 260–261, Ellis Harwood Ltd. Pub., West Sussex, England 1985).

While some of the problems of providing paper products having wet strength have at least been partially ameliorated by the art, none has solved the problems in the manner or to the extent of the present invention. It is therefore an object of this invention to provide paper products, and particularly paper tissue products, that have an initial wet strength that is significantly higher than that of the corresponding paper product formed from unmodified and untreated cellulosic fibers, and which retains sufficient strength during the period of intended use. Yet another object of the present invention is to provide paper products having an initial wet strength sufficient for use of the paper product for body cleaning in the moistened condition. It is a further object of the present invention to provide tissue paper products having an initial total wet tensile strength of at least about 80 g/inch, preferably at least about 120 g/inch.

Another object of this invention is to provide paper products that have such initial wet strengths, and which also have a rate of wet strength decay sufficient for a flushable product. It is a further object of the present invention to provide paper products having such initial total wet tensile strengths and a 30 minute total wet tensile strength of not more than 40 g/inch.

SUMMARY OF THE INVENTION

The present invention relates to paper products having relatively high levels of initial wet strength. The invention is particularly adapted to disposable absorbent paper products such as those used for househld, body, or other cleaning applications and those used for the absorption of body fluids such as urine and menses.

The paper products of the present invention comprise cellulosic fibers having free aldehyde groups. The cellulosic fibers are combined with a water-soluble polymer having functional groups capable of reacting with the aldehyde groups. The aldehyde groups on the fibers are reacted with the functional groups to form bonds joining the fibers (inter-fiber bonds are formed).

In a preferred embodiment, the cellulosic fibers contain a polysaccharide in the hemicellulose fraction in which the hydroxyl groups of at least a portion of the repeating units of the polysaccharide are cis-hydroxyl groups, preferred repeating units being mannose and galactose. Similarly, the water-soluble polymer is preferably a polysaccharide in which the hydroxyl groups of at least a portion of the repeating units of the polysaccharide are cis-hydroxyl groups. Preferred polysaccharides are those in which the repeating units are derived from one or more sugars selected from mannose, galactose, allose, altrose, gulose, talose, ribose, and lyxose.

DETAILED DESCRIPTION OF PREFERRED EMBODIMENT(S)

As used herein, the terms "paper" and "paper products" include sheet-like masses and molded products containing the modified cellulosic fibers and certain polymers that are reactive therewith. The paper products of the present invention comprise cellulosic fibers having free aldehyde groups that are combined with a water-soluble polymer having functional groups capable of reacting with the aldehyde groups. The cellulosic aldehyde groups are reacted with the polymer functional groups to form inter-fiber chemical bonds, typically covalent bonds (i.e., bonds are formed between different fibers). These bonds provide a high initial wet strength to the paper product, as compared to a corresponding paper product formed without cellulosic fibers having free aldehyde groups.

The cellulosic fibers having free aldehyde groups can be derived from cellulosic fibers of diverse natural origin. Digested fibers from softwood (i.e., derived from coniferous trees), hardwood (i.e., derived from deciduous trees) or cotton linters are preferably utilized. Fibers from Esparto grass, bagasse, kemp, flax, and other lignaceous and cellulosic fiber sources may also be utilized as raw material in the invention. Also useful in the present invention are fibers derived from recycled paper, which can contain any or all of the above categories as well as other non-fibrous materials such as fillers and adhesives used to facilitate the original paper making.

The paper products may also contain non-cellulosic fibrous polymeric material characterized by having hydroxyl groups attached to the polymer backbone, for example glass fibers and synthetic fibers modified with hydroxyl groups. Other fibrous material, e.g., synthetic fibers, such as rayon, polyethylene and polypropylene fibers, can also be utilized in combination with natural cellulosic fibers or other fibers containing hydroxyl groups. Mixtures of any of the foregoing fibers may be used. Since the strength of the paper product tends to increase with the number of hydroxyl groups in the fibers, it will usually be preferred to employ primarily, more preferably wholly, fibers having hydroxyl groups. Celluosic fibers are economically preferred.

Cellulose containing fibers in the natural state are composed of primarily of carbohydrates and lignin. The carbohydrates are almost wholly composed of long polymeric chains of anhydro-sugar units known as polysaccharides, primarily cellulose which is composed of long linear chains of β-lined anhydroglucopyranose units. Other polysaccharides present in cellulose are commonly referred to as hemicelluloses which are derived at least in part from the sugars D-glucose, D-mannose, D-galactose, D-xylose, L-arabinose, ribose (as determined by hydrolysis). The chemistry of cellulose, in regard to wood cellulose, is described in more detail in *Handbook of Pulp and Paper Technology,* 2nd Ed., Britt, pp. 3–12 (Van Nostrand Reinhold Co. 1964), incorporated herein by reference. Cellulosic fibers that are preferred for use herein are those that comprise a hemicellulose in which the hydroxyl groups of at least a portion of the repeating units of the hemicellulose are cis-hydroxyl groups. Without intending to be bound by theory, it is believed that hemicelluloses having monosaccharides with a cis-hydroxyl group stereochemistry, e.g. mannose and galactose are more rapidly oxidized than polysaccharides having sugars with trans-hydroxl groups, e.g. cellulose, and thereby enable a more rapid process for the development of high wet strength paper. Thus, preferred cellulosic fibers are those that comprise a hemicellulose derived from one or more sugars selected from mannose and galactose. Typically, the hemicellulose is derived from mannose, galactose or both. The composition of a given cellulose can be determined by hydrolysis of the cellulose material to the constituent sugars by known methods with subsequent qualitative and quantitative analysis of the hydrolyzate by separation techniques such as paper, thin-layer, or gas-liquid chromatography.

The optimum cellulosic fiber source utilized in conjunction with this invention will depend upon the particular end use contemplated. Generally wood pulps will be utilized.

Applicable wood pulps include chemical pulps, such as Kraft (i.e., sulfate) and sulfite pulps, as well as mechanical pulps including, for example, groundwood, thermomechanical pulp (i.e., TMP) and chemi-thermomechanical pulp (i.e., CTMP).

Fibers prepared by a mechanical pulp process tend to provide the highest initial total wet tensile strengths and may be preferred for this reason. Without intending to be bound by theory, it is believed that mechanical pulp processes tend to preserve the hemicellulose content and the lignin content of the cellulosic fibers. Thus, such fibers tend to have a higher content of lignin and of polysaccharides having cis-hydroxyl groups in the repeating units of the polysaccharide. Chemical pulping processes tend to remove hemicelluloses and lignin such that potential initial wet strengths may not be achieved with such pulps. However, chemical pulps are often preferred since they impart a superior tactile sense of softness to paper products made therefrom. Paper products made with aldehyde-functionalized chemical pulp fibers in accordance with the present invention may therefore provide a particularly suitable balance of softness and initial wet strength. In further regard to chemical pulps, kraft fibers are preferred to sulfite fibers since less hemicellulose tends to be removed in the kraft process leading to higher levels of initial wet tensile strength.

Both softwood fibers and hardwood kraft fibers contain cellulose and hemicelluloses. However, the types of hemicelluloses in softwood fibers are different from those in hardwood fibers and contain a higher weight % of galactose and mannose. For example, *The Handbook of Pulp and Paper Technology,* 2nd Ed., Britt, p. 6 (Van Nostrand Reinhold Co. 1964), describes the mannan content of softwoods in the range of from 10 to 15%, while hardwoods have a mannan content of usually only 2 to 3%. The types of lignin in softwood also differs from that of hardwood.

In a preferred embodiment, the cellulosic fibers are softwood fibers. It has been found that the softwood fibers having aldehyde groups in accordance with the present invention produce paper structures having unexpectedly higher levels of initial wet tensile than paper structures formed from hardwood fibers having aldehyde groups. While it is well known in the papermaking art that softwood fibers are longer than hardwood fibers and that softwood fibers produce paper having a higher strength than paper formed from hardwood fibers, it is believed that softwood fibers, having a higher weight percentage of hemicellulose galactose and/or mannose than hardwood fibers, form a greater number of aldehyde groups on the cellulosic polymer chain. This greater number of aldehyde groups tends to increase the difference in wet strength typically observed between softwood and hardwood fibers.

Completely bleached, partially bleached and unbleached fibers are applicable. It may frequently be desired to utilize bleached pulp for its superior brightness and consumer appeal.

The cellulosic fibers employed in the paper products of the present invention are modified to contain free aldehyde groups. By "free" aldehyde groups, it is meant that the aldehyde groups are capable of reacting with the water-soluble polymer material having functional groups. The cellulosic fibers can be modified to contain the aldehyde groups by converting at least a portion of the cellulosic hydroxyl groups to intrafiber and/or interfiber aldehyde groups, typically both intrafiber and interfiber aldehyde groups. Alternatively, this can be accomplished by graft copolymerization of aldehyde functionalities, for example as described by T. G. Gafurov et al. in Strukt. Modif. Khlop. Tsellyul., Vol. 3, pp. 131–135 (1966), which describes the application of acrolein to cellulose. In a preferred embodiment, the cellulosic fibers are modified by converting cellulosic hydroxyl groups to intrafiber and/or interfiber aidehyde groups (more preferably both intrafiber and interfiber aldehyde groups). The hydroxyl groups can be converted to aldehyde groups by treating the fibers with an oxidizing agent under conditions that cause the formation of such groups. In general, the modification by way of oxidation is performed by dispersing the fibers in an aqueous liquid medium, contacting the fibers with an oxidizing agent, and reacting hydroxyl groups in the cellulosic fibers with the oxidizing agent to form aldehyde groups. The oxidizing agent may react with hydroxyl groups in any of the components of the fibers, including the cellulose, hemicellulose, and/or lignin.

The aqueous liquid medium enables the dispersion of the fibers such that intimate and uniform contact can be achieved between the fibers and the oxidizing agent to thereby provide a higher and more uniform yield. In addition to water, the liquid medium may comprise one or more materials which in combination will effect such dispersion but which will not dissolve the unmodifed fibers or the oxidized fibers. Water is an economically preferred liquid medium.

The amount of the aqueous liquid medium and the fibers in the dispersion may vary over a wide range. Typically, the dispersion comprises from about 0.1 to about 50 weight % of the fibers and from 99.9 to about 50 weight % of the liquid medium. Thus, the dispersion can be low consistency (e.g., about 3% fiber/97% aqueous liquid medium, medium consistency (e.g., about 8–16% fiber/92–84% aqueous liquid medium), or high consistency (e.g., about 20–50% fiber/50–80% aqueous liquid medium).

The fibers can be dispersed in the medium by any suitable method such as are known in the art. Conventional agitation equipment, e.g., mechanical stirrers, are typically used for low consistency oxidation. Dispersion is typically achieved after agitating for a period of about 30–60 minutes.

The fibers in the dispersion are then contacted with an oxidizing agent under conditions to cause oxidation of cellulosic hydroxyl groups to form aldehyde groups on the fibers (i.e., intra-fiber aldehyde groups are formed). Contact of the fibers and the oxidizing agent is preferably assisted by the use of an agitation means, e. g., a mechanical stirrer.

Suitable oxidizing agents are those compounds that will react with the hydroxyl groups of the cellulosic fibers to increase the carbonyl content of the fibers. Suitable oxidizing agents include oxidizing agents that are believed to function through free radical oxidation, such as hypochlorous acid, hypobromous acid, hypoiodous acid, persulfates, peroxides, perborates, perphosphates, and any of the known free radical polymerization initiators. Other oxidizing agents suitable for use herein include ozone, chromic acid, nitrogen dioxide, and periodates. In general, the oxidizing agent of choice is dissolved in water and mixed with the fibers to be oxidized. During the oxidation step, at least a portion of the hydroxyl groups of the cellulosic fibers are converted to aldehyde groups. Without intending to be bound by theory, it is believed that at least a portion of the aldehydes are present on the fiber surface to facilitate interfiber bonding during the papermaking process. The formation and quantification of aldehyde groups can be detected by known analytical techniques such as infrared analysis. Alternatively, the presence of aldehyde groups is evidenced by an increase in the wet strength of a paper product formed from the oxidized fibers, relative to a corresponding paper product formed from non-oxidized fibers. In general, for a given fiber weight, oxidizing agent concentration, and set of reaction conditions, oxidation increases with increasing time of exposure to the oxidizing agent. Thus, the degree of oxidation can be readily optimized for a given fiber weight by quantifying the aldehyde content as a function of time by any of the foregoing methods. It will be desired to avoid the over oxidation of the fibers to cause significant formation of carboxylic acid groups, which can be detected and quantified using similar techniques.

Ozone oxidation can be accomplished by introducing ozone into the dispersion. The ozone may be introduced by injecting the gas under pressure into the dispersion. The pH of the dispersion is preferably adjusted to an initial pH of from about 4 to about 8, more preferably from about 7 to about 8. Although the flow rate and pressure of the ozone may vary over a wide range, exemplary conditions include a flow rate of about 8.0 liters/minute and a flow pressure of about 8 psig. The dispersion is preferably cooled, e.g., to temperatures of about 0° C. or less, to maximize the solubility of the ozone in the dispersion. Antifoaming agents such as are known in the art may be added to the mixture to minimize foaming. The oxidation reaction is typically completed by introducing the ozone under the foregoing conditions for a period ranging from about 30 to about 60 minutes. Oxidation by other oxidizing agents is further described in the Examples.

The oxidized fibers are then combined with a water-soluble polymer that contains functional groups capable of chemically reacting with the aldehyde groups. As used herein, "water soluble" includes the ability of a material to be dissolved, dispersed, swollen, hydrated or similarly admixed in water. Similarly, as used herein "substantially dissolving" includes dissolution, dispersion, hydration, swelling, and the like admixture with a liquid medium. Typically the mixture forms a generally uniform liquid mixture having, to the naked eye, one physical phase.

Suitable water soluble polymers contain functional groups selected from hydroxyl groups and amide groups, including polysaccharides, polyvinyl alcohol, and polyacrylamides. Since the wet strength decay rate tends to increase with polymers having amide groups, polymers containing such groups are not preferred for where paper having temporary wet strength is desired. In a preferred embodiment, the polymer is a water-soluble polysaccharide in which at least a portion of the hydroxyl groups in at least a portion of the repeating units of the polysaccharide are cis-hydroxyl groups. For example, the polysaccharide is suitably derived from one or more sugars selected from the group consisting of mannose, galactose, allose, altrose, gulose, talose, ribose, and lyxose. Economically preferred polysaccharides are derived from mannose, galactose or both. Such preferred polysaccharides therefore include guar gum and locust bean gum. The polysaccharides may contain sugars other than those specifically mentioned. The sugar content of the polysaccharide can be determined by hydrolysis of the polysaccharide to the constituent sugars by known methods with subsequent qualitative and quantitative analysis of the hydrolyzate by separation techniques such as paper, thin-layer, or gas-liquid chromatography.

The polymer may be a neutral polymer, an electronically charged polymer, or a charge balanced mixture of polymers. Electronically charged derivatives, e.g., ionic derivative, include cationic and anionic derivatives. By "charge balanced mixture" of polymers, it is meant that the total amounts of each of the electronically charged polymers are selected so as to provide an essentially neutral polymer mixture. However, the polymer should be selected such that it will not result in excessive electrostatic repulsion between the fibers and the polymer. Since the fibers are typically negatively charged (anionic), neutral polymers or cationic polymers will typically be preferred.

The initial wet tensile strength tends to increase with the molecular weight of the polymer. Therefore, for high initial wet strength, it is generally preferred to use polymers having a relatively high molecular weight. Electronically charged polymers tend to have lower molecular weights than the corresponding neutral polymer from which they are made, such that the neutral polymers may provide higher initial wet tensile strengths, if each polymer has comparable retention.

Polysaccharides that are suitable for use herein are commercially available guar gums from Hercules Chemical Co. of Passaic, N.J. under the trade names Galactosol and Supercol, and anionic or cationic derivatives.

The aldehyde-functionalized cellulosic fibers and the water-soluble polymer are combined in a manner which allows the polymers to form a bonded fiber mass, generally in the form of a sheet containing the fibers (i.e., a paper product is formed). The bonded fiber mass has a dry strength and an initial wet strength that is higher than a comparable fiber mass with non-aldehyde functionalized fibers and the polymer. The polymer may be combined with the cellulosic fibers in the wet-end of a papermaking process such as are known in the art. Alternatively, the polymer may be combined with the cellulosic fibers by spraying or printing the polymer, typically in the form of an aqueous solution or dispersion, onto the fibers after they are set in the paper making process.

In forming paper generally in the form of sheets, the polymer is preferably combined with the cellulosic fibers in the wet-end of a wet-laid paper-making process such as are known in the art. Wet laid paper making processes typically include the steps of providing a slurry containing the cellulosic fibers (the slurry is alternatively referred to herein as a paper making furnish), depositing the slurry of fibers on a substrate such as a foraminous forming wire (e.g., a Fourdrinier wire), and setting the fibers into a sheeted form while the fibers are in a substantially unflocculated condition. The step of setting the fibers into sheeted form may be performed by allowing the fluid to drain and pressing the fibers against the foraminous wire (dewatering), for example, with a screened roll, such as a cylindrical Dandy Roll. Once set, the fibrous sheet may then be dried and optionally compacted as desired Thus, in a wet-laid paper making process, the polymer is preferably combined with the cellulosic fibers by adding the polymer to the paper making furnish, generally an aqueous paper making furnish comprising water and the cellulosic fibers. In a preferred embodiment, the polymer is added to the furnish after substantially dissolving the polymer in a suitable liquid medium. Where the polymer is hydrated by the medium, for example, in the case of guar gum, it is preferred to bring the polymer to its equilibrium swell. In an alternative embodiment, the polymer is added directly to the furnish. The furnish is adjusted, if necessary, to a pH of about 7 or less, preferably from about 4 to about 7.

The polymer must remain in contact with the cellulosic fibers, prior to setting the fibers, for a period sufficient to allow adsorption of the polymer by the fibers and bonding between the polymer and the cellulosic fibers. Otherwise the polymer may be lost during the setting step such that the wet strength improvements are not obtained. A sufficient period is typically achieved by leaving the polymer in contact with the cellulosic fibers for a period of from a few seconds to about 60 minutes prior to setting the fibers, more typically on the order of a few to 60 seconds. Bonding may involve ionic bonding and/or covalent bonding.

The temperature of the furnish will generally be between greater than 0° C. and less than 100° C. and is more typically at about room temperature (20–25° C.). The paper making process is generally conducted in air at atmospheric pressure, although other environments and pressures may be used.

Once the furnish is prepared, it is converted into final web or sheet form by any suitable wet laying method, including a method previously described as involving deposition of the furnish, setting of the fibers, drying and optionally compacting.

The amount of polymer that is combined with the aldehyde-functionalized cellulosic fibers is generally selected to provide a balance of initial wet tensile strength, wet tensile decay and optionally other properties, including dry strength, consistent with the objects of the invention. In general, an increase in the amount of the polymer tends to result in an increase in dry strength and initial wet tensile strength (particularly in dry strength) and a decrease in softness. The paper products will typically contain from about 0.01 to about 5 weight % of the polymer, based on the weight of the aldehyde-functionalized cellulosic fibers. Preferably, the paper products will contain from about 0.01 to about 3 weight % of the polymer, based on the weight of the cellulosic fibers. For example, a particularly suitable paper product contains about 2 weight % of the polymer, based on the weight of the aldehyde-functionalized cellulosic fibers.

The wet strength develops through the formation of fiber-fiber bonds and/or fiber-polymer bonds. Without intending to be limited by theory, fiber-fiber bonding is believed to occur through the reaction of the aldehyde groups with hydroxyl groups on proximate fibers to form hemi-acetal bonds. The polymer provides additional sites for the aldehyde groups to react to form bonds, with inter-fiber bonding then occurring through bonding of a fiber to the polymer to another fiber. More specifically, the polymer is believed to react with the cellulosic fibers to form hemiacetal or N-acylhemiaminal groups through reaction of at leak a portion of the aldehyde groups on the cellulosic fibers and at least a portion of the functional groups of the polymer (hydroxyl groups or amide groups, respectively) as the paper product dries. The resultant network tends to have a higher flexibility and a relatively high initial wet tensile strength compared to interfiber bonded networks formed from non-oxidized fibers or from oxidized fibers in the absence of the polymer. The hemiacetal and N-acylhemiamininal linkages are reversible in water, slowly reverting to the original aldehyde-functionalized fibers and polymer materials. This reversibility confers temporary wet strength to the paper product. The N-acylhemiaminal groups revert more slowly than the hemiacetal groups such that the wet strength of paper products comprising such groups has a more permanent nature.

The present invention is particularly suitable for paper products which are to be disposed into sewer systems, such as toilet tissue. However, it is to be understood that the present invention is applicable to a variety of other paper products including disposable paper products including writing paper and more absorbent products such as those used for household, body, or other cleaning applications and those used for the absorption of body fluids such as urine and menses. Exemplary paper products thus include writing paper, tissue paper including toilet tissue and facial tissue, paper towels, absorbent materials for diapers, feminine hygiene articles including sanitary napkins, pantiliners and tampons, adult incontinent articles and the like.

Tissue paper of the present invention can be homogeneous or multi-layered construction; and tissue paper products made therefrom can be of a single-ply or multi-ply construction. The tissue paper preferably has a basis weight of between about 10 g/m$^2$ and about 65 g/m$^2$, and density of about 0.6 g/cm$^3$ or less. More preferably, the basis weight will be about 40 g/m$^2$ or less and the density will be about 0.3 g/cm$^3$ or less. Most preferably, the density will be between about 0.04 g/cm$^3$ and about 0.2 g/cm$^3$. See Column 13, lines 61–67, of U.S. Pat. 5,059,282 (Ampulski et al), issued Oct. 22, 1991, which describes how the density of tissue paper is measured. (Unless otherwise specified, all amounts and weights relative to the paper are on a dry basis.) The tissue paper may be conventionally pressed tissue paper, pattern densified tissue paper, and uncompacted, nonpattern-densified tissue paper. These types of tissue paper and methods for making such paper are well known in the art and are described, for example, in U.S. Pat. 5,334,286, issued on Aug. 2, 1994 in the names of Dean V. Phan and Paul D. Trokhan, incorporated herein by reference in its entirety.

Experimental

The following illustrates the preparation and testing of exemplary paper products according to the present invention. Abbreviations appearing in the Examples have the following meaning:

NSK—Northern softwood kraft
E—eucalyptus
sulfite—acid sulfite pulp fibers
CTMP—chemical thermomechanical pulp fibers
"OX"—oxidized fibers Handsheet Preparation Handsheets are made essentially according to TAPPI standard T205 with the following modifications:

(1) tap water, adjusted to a desired pH, generally between 4.0 and 4.5, with $H_2SO_4$ and/or NaOH is used;
(2) the sheet is formed on a polyester wire and dewatered by suction instead of pressing;
(3) the embryonic web is transferred by vacuum to a polyester papermaking fabric;
(4) the sheet is then dried by steam on a rotary drum drier.

In accordance with the present invention, in some examples a water-soluble polymer is combined with the aldehyde-functionalized cellulosic fibers. After dispersing the fibers in tap water, the polymer is added to the disintegrated pulp and the slurry is agitated for a fixed period of time ranging from 1 to 60 minutes.

Strength Tests

The paper products are aged prior to tensile testing a minimum of 24 hours in a conditioned room where the temperature is 73° F.±4° F. (22.8° C.±2.2° C.) and the relative humidity is 50% ±10%.

1. Total Dry Tensile Strength ("TDT")

This test is performed on one inch by five inch (about 2.5 cm×12.7 cm) strips of paper (including handsheets as described above, as well as other paper sheets) in a conditioned room where the temperature is 73° F.±4° F. (about 28° C.±2.2° C.) and the relative humidity is 50% ±10%. An electronic tensile tester (Model 1122, Instron Corp., Canton, Mass.) is used and operated at a crosshead speed of 2.0 inches per minute (about 5.2 cm per min.) and a gauge length of 4.0 inches (about 10.2 cm). Reference to a machine direction means that the sample being tested is prepared such that the 5" dimension corresponds to that direction. Thus, for a machine direction (MD) TDT, the strips are cut such that the 5" dimension is parallel to the machine direction of manufacture of the paper product. For a cross machine direction (CD) TDT, the strips are cut such that the 5" dimension is parallel to the cross-machine direction of manufacture of the paper product Machine-direction and cross-machine directions of manufacture are well known terms in the art of paper-making.

The MD and CD tensile strengths are determined using the above equipment and calculations in the conventional manner. The reported value is the arithmetic average of at least six strips tested for each directional strength. The TDT is the arithmetic total of the MD and CD tensile strengths.

2. Wet Tensile

An electronic tensile tester (Model 1122, Instron Corp.) is used and operated at a crosshead speed of 1.0 inch (about 1.3 cm) per minute and a gauge length of 1.0 inch (about 2.5 cm), using the same size strips as for TDT. The two ends of the strip are placed in the upper jaws of the machine, and the center of the strip is placed around a stainless steel peg. The strip is soaked in distilled water at about 20° C. for the desired soak time, and then measured for tensile strength. As in the case of the TDT, reference to a machine direction means that the sample being tested is prepared such that the 5" dimension corresponds to that direction.

The MD and CD wet tensile strengths are determined using the above equipment and calculations in the conventional manner. The reported value is the arithmetic average of at least six strips tested for each directional strength. The total wet tensile strength for a given soak time is the arithmetic total of the MD and CD tensile strengths for that soak time. Initial total wet tensile strength ("ITWT") is measured when the paper has been saturated for 5±0.5 seconds. 30 minute total wet tensile ("30 MTWT") is measured when the paper has been saturated for 30±0.5 minutes.

The following non limiting examples are provided to illustrate the present invention. The scope of the invention is to be determined by the claims which follow.

Preparation of Oxidized Cellulosic Fibers

EXAMPLE 1

The following examples illustrate the effect of fiber type on the attainment of wet strength. Handsheets are prepared from various types of fibers and ozone oxidized fibers of the same type.

The cellulosic fibers are ozone oxidized in the following manner. A mixture of fibers and tap water (0.9–1.3 wt % fibers) in a suitable container is strred at room temperature until the fibers are well dispersed. The pH of the mixture is then adjusted to about 8 with an inorganic acid or base and the fibers are ozone oxidized. The fibers are oxidized with ozone by bubbling ozone through the mixture with vigorous stirring (mechanical stirrer) for a period of 30–35 minutes. The ozone is introduced into the mixture using a Polymetrics model T-816 ozone generator, run on oxygen feed at a gauge pressure of 8 psig, a flow rate of 8.0 liters/minute, and a voltage of 115 volts. The mixture is generator cooled to a temperature of from 15° C. to −20° C. during the oxidation process.

After the oxidation, the water is drained from the fibers on a Buchner funnel and the fibers are further dewatered by centrifugation.

Handsheets (18 lb/3000 $ft^2$ or 26 lb/3000 $ft^2$) are prepared as previously described and ITWT, TDT and 30MTWT are determined. The handsheets provide tensile values as shown in Table 1.

TABLE 1

| Fiber identity | basis wt. (lb/3000 $ft^2$) | Initial pH | Final pH | ITWT (gm/in) | TDT (gm/in) | 30 MTWT (gm/in) |
|---|---|---|---|---|---|---|
| NSK | 18 | 7.92 | — | 15 | 1165 | — |
| NSK-OX | 18 | 6.44 | — | 186 | 2418 | 75 |
| NSK | 26 | 7.8 | — | 42 | 3732 | — |
| NSK-OX | 26 | 7.8 | 6.18 | 348 | 3896 | 191 |
| E | 18 | 7.84 | — | <10 | 85 | — |
| E-OX | 18 | 5.02 | — | 66 | 673 | 12 |
| E/NSK (80/20 by wt) | 18 | 7.88 | — | 8 | 464 | — |
| E/NSK-OX (80/20 by wt) | 18 | 4.96 | — | 108 | 1520 | 52 |
| sulfite | 18 | 7.88 | — | 8 | 128 | — |
| sulfite-ox | 18 | 7.88 | 4.45 | 30 | 202 | — |
| CTMP | 18 | 7.99 | — | 38 | 1461 | — |
| CTMP-OX | 18 | 7.99 | 5.28 | 184 | 1608 | 184 |
| CTMP | 26 | 8 | — | 60 | 2627 | — |
| CTMP-OX | 26 | 8 | 6.05 | 450 | 3075 | 214 |
| CTMP/NSK (60/40 by wt) | 26 | — | — | 70 | 3476 | 26 |
| CTMP/NSK-OX (60/40 by wt) | 26 | — | — | 384 | 3678 | 214 |
| CTMP/NSK (60/40 by wt) | 26 | 7.92 | — | 66 | 3509 | — |
| CTMP/NSK-OX (60/40 by wt) | 26 | 7.92 | 6.10 | 430 | 4111 | 180 |

Table 1 shows that oxidized kraft (softwood) fibers provide over three times the ITWT that oxidized eucalyptus (hardwood) fibers produce. This is believed to be due to the much higher weight percentage of wood polysaccharides (hemicelluloses) having the cis-hydroxyl group stereochemistry in the monomer units in softwood fibers than is present in hardwood fibers.

Table 1 further shows that oxidized CTMP fibers provide even higher ITWT than kraft fibers. In the mechanical pulp most of the hemicellulose and lignin that is present in the natural wood is retained, which is believed to contribute to the higher ITW. The presence of the oxidized lignin appears to contribute a more permanent type of wet tensile strength which may be particularly useful for paper towel applications.

The presence of hemicelluloses containing galactose and/or mannose tend to contribute to the attainment of ITWT and TDT. Therefore, fibers that have a greater percentage of these sugars in the native fiber tend to provide higher ITWT. In addition, pulping processes that tend to preserve the hemicellulose content tend to provide higher ITWT. Therefore, softwood fibers will provide higher ITWT than hardwood fibers, and mechanical pulps tend to provide higher ITWT than chemical pulps. Moreover, chemical pulp processes that tend to preserve the hemicellulose content will tend to provide higher ITWT. An acid sulfite process tends to efficiently remove the galactose and mannose containing hemicelluloses with a resultant low ITWT relative to kraft fibers. Modifications of conventional kraft process (e.g., kraft/oxygen, polysulfide pulping, high sulfidity digesting, etc.) that preserve a higher weight percent of hemicellulose in the fibers would tend to provide higher ITWT in ozone oxidized fibers prepared by such processes, than the ITWT provided by ozone oxidized fibers produced through conventional kraft pulping.

EXAMPLE 2

The following example illustrates the effect of oxidation pH on the initial total wet tensile strength of handsheets prepared from the ozone oxidized cellulosic fibers.

The cellulosic fibers are ozone oxidized in the following manner. A mixture of Eucalyptus fibers, NSK fibers (80/20 by wt) and tap water (about 0.9 wt % fibers) is stirred at room temperature until the fibers are well dispersed. The pH of the mixtures is then adjusted with inorganic acid or base to an initial value and the fibers are ozone oxidized as described in Example 1 for a period of 30 minutes. The final pH of the mixture is measured after the 30 minute oxidation period. Handsheets (18 lb/3000 $ft^2$) are prepared as previously described and ITWT and TWT determined The handsheets provide tensile values as shown in Table 2. Where more than one value is shown, this reflects that multiple of samples tested.

TABLE 2

| Initial pH | Final pH | ITWT | ITWT average |
|---|---|---|---|
| 2 | 2.04 | 53.3 | — |
| 3 | 2.93 | 58.8 | — |
| 4 | 3.91/3.7 | 48.1/61 | 54.6 |
| 5 | 4.26/4.13 | 42.4/76.4 | 59.4 |
| 6 | 4.39 | 88.3 | — |
| 7 | 4.61/4.43 | 61.4/78.5 | 70 |
| 8 | 5.11 | 106.4 | — |
| 9 | 6.32/5.92 | 60.9/97.4 | 79.2 |
| 10 | 7.31 | 87.2 | — |
| 11 | 7.64 | 64.2 | — |
| 12 | 11.63/11.49 | 26.8/29.8 | 28.3 |

Table 2 shows that the maximum initial wet tensile strength is produced with an initial oxidation pH of about 8. Highly alkaline pH (>about 11) is detrimental to the development of wet tensile with ozone oxidized fibers.

EXAMPLE 3

The following example illustrates the effect of fiber oxidation time on the development of wet strength in paper tissue comprised of one cellulosic fiber mixture.

A mixture of 54 gm Eucalyptus fibers and 36 gm Northern Softwood Kraft fibers (60/40 E/NSK) is slurried in 3.0 liter of tap water. The fibers are ozone oxidized as described in Example 1 for a period of 40–75 minutes in 5 minute increments. Handsheets (18 lb/3000 $ft^2$) are prepared as previously described and ITWT and TDT determined. The handsheets provide tensile values as shown in Table 3

TABLE 3

| Oxidation time (minutes) | ITWT (gm/in) | TDT (gm/in) |
|---|---|---|
| 40 | 81 | 1104 |
| 45 | 91 | 775 |
| 50 | 152 | 566 |
| 55 | 141 | 1083 |
| 60 | 166 | 1253 |
| 65 | 159 | 1224 |
| 70 | 120 | 1126 |
| 75 | 117 | 1197 |

Table 3 shows that maximum initial total wet tensiles are provided with a fiber oxidation period of from 55 minutes up to 65 minutes. Extended periods of oxidation may result in the oxidation of aldehyde groups, thereby causing a decrease in the initial total wet strength.

Preparation of Paper Tissue from Oxidized Fibers and Polyhydroxy Polymers

EXAMPLE 4

The following examples illustrate the preparation of paper tissue from ozone oxidized cellulosic fibers and several additives.

A mixture of 54 gm Eucalyptus fibers and 36 gm Northern Softwood Kraft fibers (60/40 E/NSK) is slurried in 3.0 liter of water. The initial pH of the slurry is from 7–8. The fibers are oxidized with ozone as described in Example 1 for a period of one hour. Handsheets (18.5 lb/3000 $ft^2$ basis weight) are prepared as previously described with several additives shown in Table 4. The handsheets include 2% of the additive on fiber basis. The handsheets provide ITWT and TDT as shown Table 4

TABLE 4

| additive identity* | ITWT (gm/in) | ITWT avg. | TDT (gm/in) | TDT avg. |
|---|---|---|---|---|
| no additive | 111/108/134 | 118 | 1085/1987/1244 | 1439 |
| Guar Gum (Sigma Chemical Co.) | 274/289 | 282 | 2834/1558 | 21% |
| Cationic Guar Gum (Hercules Chemical Co.) | 170 | — | 2733 | — |
| Locust Bean Gum (Sigma Chemical Co.) | 268 | — | 3132 | — |
| ozone oxidized guar gum (laboratory preparation, to Contain aldehyde groups) | 245 | — | 1666 | — |
| Cato-31 Cationic Starch (National Starch & Chemical) | 193 | — | 3441 | — |
| Redihond 5327 Cationic Starch (National Starch & Chemical) | 151 | — | 2489 | — |
| Oxidation Filtrate | 106 | — | 1113 | — |
| Polyacrylamide 19,0926 (Aldrich Chemical Co.) | 129 | — | 1713 | — |
| Acco 711 (polyacrylamide; Cytec Industries) | 118 | — | 3181 | — |
| Polyvinyl Alcohol 36,306–5 (Aldrich Chemical Co.) | 83 | — | 1080 | — |

As shown in Table 4, several additives increase the initial total wet tensile of the paper product formed from the oxidized fibers. Exceptionally high levels of ITWT are surprisingly obtained when guar gum or locust bean gum, which contain monomers having the cis-hydroxyl group stereochemistry, are included in the handsheet.

EXAMPLE 5

The following examples illustrate the preparation of paper tissue using cellulosic fibers oxidized with various oxidizing agents and treated with guar gum. 80% eucalyptus/20% NSK fiber is oxidized with the agents listed in Table 5.

Hypochlorous acid oxidation is performed as follows. An 80/20 by weight mixture of eucalyptus fibers and NSK fibers is slurried in water at 1% consistency. The pH is adjusted to 3.5–4.0 with sulfric acid. A 5% aqueous solution of sodium hypochlorite is then added to the fiber slurry to bring the slurry to a pH of 7.5–8.0. Sulfuric acid is then added to bring the pH to 6.0. The slurry is stirred overnight at room temperature. The pH is then adjusted to 4.0–4.5 and handsheets (18.5 lb/3000 $ft^2$) are prepared with 2 weight % guar gum on a fiber basis, as previously described Persulfate oxidation is performed as follows. An 80/20 by weight mixture of eucalyptus fibers and NSK fibers is slurried in water at 1% consistency. The pH is adjusted to 7.0 with nitric acid and 5 weight % sodium persulfate on a fiber basis is added 1 weight % cupric sulfate on a fiber basis is added and the slurry is stirred for about 12 hours at room temperature. The pH is then adjusted to 4.0–4.5 with nitric acid and handsheets (18.5 lb/3000 $ft^2$) are prepared with 2 weight % guar gum on a fiber basis, as previously described.

Hydrogen peroxide oxidation is performed as follows. An 80/20 by weight mixture of eucalyptus fibers and NSK fibers is slurried in water at 1% consistency. 5 weight % hydrogen peroxide on a fiber basis is added. The pH is adjusted to 8.0 with sodium hydroxide, and 0.5 weight % cupric sulfate on a fiber basis is added. The pH is readjusted to 8.0. The slurry is stirred for about 12 hours at room temperature. The pH is then adjusted to 4.0–4.5 with sulfuric acid and handsheets (18.5 lb/3000 $ft^2$) are prepared with 2 weight % guar gum (GG) on a fiber basis, as previously described Handsheet ITWT and TDT are displayed in Table 5.

TABLE 5

| Oxidizing Agent/Additive | ITWT (gm/in) | TDT (gm/in) |
|---|---|---|
| ozone/none | 108 | 1987 |
| ozone/GG | 274 | 2834 |
| hypochlorous acid/none | 186 | 1184 |
| hypochlorous acid/GG | 493 | 2845 |
| sodium persulfate/none | 155 | 1070 |
| sodium persulfate/GG | 354 | 2812 |
| hydrogen peroxide/none | 88 | 566 |
| hydrogen peroxide/GG | 217 | 1625 |

Ozone, hypochlorous acid, sodium persulfate and hydrogen peroxide produce oxidized fibers which when combined with guar gum in papermaking have exceptional levels of ITWT. Fibers oxidized with hypochlorous acid provide a particularly high level of ITWT.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A paper product comprising paper having an initial total wet tensile strength of at least about 80 g/inch and a 30 minute total wet tensile strength of not more than about 40 g/inch, wherein said paper comprises bleached cellulosic pulp fibers whereby said bleached cellulosic pulp fibers are modified to contain free aldehyde groups said free aldehyde groups formed by the reaction of said bleached cellulosic pulp fibers with an oxidizing agent so as to convert a portion of the hydroxyl groups of said bleached cellulosic pulp fiber to aldehyde groups, said bleached cellulosic pulp fibers combined with a water-soluble polymer having functional groups capable of reacting with said free aldehyde groups, said free aldehyde groups being reacted with said functional groups to form chemical bonds joining said fibers.

2. The paper product of claim 1 wherein said polysaccharide of said cellulosic fibers comprises galactose, mannose or both.

3. The paper product of claim 1 wherein said cellulosic fibers having free aldehyde groups are derived from softwood fibers.

4. The paper product of claim 1 wherein said cellulosic fibers comprise cellulosic fibers in which at least a portion of the cellulosic hydroxyl groups have been converted to aldehyde groups.

5. The paper product of claim 4 wherein said cellulosic fibers are cellulosic fibers treated with an oxidizing agent to convert at least a portion of the cellulosic hydroxyl groups to aldehyde groups.

6. The paper product of claim 5 wherein said oxidizing agent is ozone.

7. The paper product of claim 1 wherein said functional groups capable of reacting with said aldehyde groups are selected from the group consisting of hydroxyl groups and amide groups.

8. The paper product of claim 1 wherein said polymer having functional groups capable of reacting with said aldehyde groups is selected from the group consisting of polysaccharides, polyvinyl alcohol, and polyacrylamides.

9. The paper product of claim 8 wherein said polymer is a polysaccharide in which at least a portion of the hydroxyl groups in at least a portion of the repeating units of the polysaccharide are cis-hydroxyl groups, said aldehyde groups of said fibers being reacted with at least a portion of said cis-hydroxyl groups to form chemical bonds joining said fibers.

10. The paper product of claim 9 wherein said polysaccharide is derived from a sugar selected from the group consisting of mannose, galactose, allose, altrose, gulose, talose, and lyxose.

11. The paper product of claim 10 wherein said polysaccharide is derived from a sugar selected from the group consisting of mannose and galactose.

12. The paper product of claim 11 wherein said polysaccharide is selected from the group consisting of guar gum, locust bean gumn, cationic guar gum, cationic locust bean gum, anionic guar gum, and anionic locust bean gum.

13. The paper product of claim 9 wherein said polysaccharide is a neutral polysaccharide or a charge balanced mixture of polysaccharides.

14. The paper product of claim 1 wherein the product contains from about 0.5% to 10% of said polymer, based on the weight of said cellulosic fibers.

15. A paper product comprising paper having an initial total wet tensile strength of at least about 80 g/inch and a 30 minute total wet tensile strength of not more than about 40 g/inch, wherein said paper comprises cellulosic fibers having free aldehyde groups, said fibers being derived from bleached cellulosic pulp fibers comprising a polysaccharide in which the hydroxyl groups of at least a portion of the repeating units of the polysaccharide are cis-hydroxyl groups, wherein at least a portion of the cellulosic hydroxyl groups have been converted to aldehyde groups, said fibers being combined with a water-soluble polysaccharide in which at least a portion of the hydroxyl groups in at least a portion of the repeating units of the polysaccharide are cis-hydroxyl groups, said aldehyde groups of said fibers being reacted with at least a portion of said cis-hydroxyl groups to form chemical bonds joining said fibers.

16. The paper product of claim 15 wherein said cellulosic fibers comprise a polysaccharide derived from galactose, mannose or both, and said water-soluble polysaccharide is derived from a sugar selected from the group consisting of mannose, galactose, allose, altrose, gulose, talose, lyxose and combinations thereof.

17. The paper product of claim 15 wherein said cellulosic fibers are cellulosic fibers treated with an oxidizing agent to convert at least a portion of the cellulosic hydroxyl groups to aldehyde groups.

18. The paper product of claim 17 wherein said oxidizing agent is ozone.

19. The paper product of claim 16 wherein said polysaccharide is a neutral polysaccharide of a charge balanced mixture of polysaccharides selected from the group consisting of guar gum, locust bean gum, cationic guar gum, cationic locust bean gum, anionic guar gum, and anionic locust bean gum.

20. The paper product of claim 15 wherein the product contains from about 0.5% to 10% of said polymer, based on the weight of said cellulosic fibers.

* * * * *

UNITED STATES PATENT AND TRADEMARK OFFICE

CERTIFICATE OF CORRECTION

PATENT NO. : 6,319,361 B1
DATED : November 20, 2001
INVENTOR(S) : David Jay Smith et al.

It is certified that error appears in the above-identified patent and that said Letters Patent is hereby corrected as shown below:

Column 2,
Line 37, “Unfortuately,” should read -- Unfortunately --.

Column 4,
Line 31, “Celluosic” should read -- Cellulosic --.
Line 37, “β-lined” should read -- β-linked --.
Line 52, “trans-hydroxl” should read -- trans-hydroxyl --.

Column 6,
Line 6, “aidehyde” should read -- aldehyde --.
Line 24, "unmodifed" should read -- unmodified --.

Column 8,
Line 49, “desired” should read -- desired. --.

Column 9,
Line 46, “leak” should read -- least --.
Line 54, “N-acylhemiamininal” should read -- N-acylhemiaminal --.

Column 12,
Line 44, “ITW” should read -- ITWT --.

Column 13,
Line 13, “determined ” should read -- determined. --.

UNITED STATES PATENT AND TRADEMARK OFFICE

CERTIFICATE OF CORRECTION

PATENT NO. : 6,319,361 B1
DATED : November 20, 2001
INVENTOR(S) : David Jay Smith et al.

It is certified that error appears in the above-identified patent and that said Letters Patent is hereby corrected as shown below:

Column 15,
Line 12, “sulfric” should read -- sulfuric --.
Line 18, “described ” should read -- described. --.
Line 24, “added ” should read -- added. --.
Line 38, “described ” should read -- described. --.

Signed and Sealed this

Fourth Day of June, 2002

*Attest:*

*Attesting Officer*

JAMES E. ROGAN
*Director of the United States Patent and Trademark Office*